US006268786B1

(12) United States Patent
Buswell

(10) Patent No.: US 6,268,786 B1
(45) Date of Patent: Jul. 31, 2001

(54) SHIELDED WIRE CORE INDUCTIVE DEVICES

(76) Inventor: Harrie R. Buswell, 132 Lorraine Ct., Berea, KY (US) 40403

( * ) Notice: Subject to any disclaimer, the term of this patent is extended or adjusted under 35 U.S.C. 154(b) by 0 days.

(21) Appl. No.: 09/309,404

(22) Filed: May 10, 1999

Related U.S. Application Data

(63) Continuation-in-part of application No. 09/203,105, filed on Nov. 30, 1998.

(51) Int. Cl.[7] ..... H01F 27/02; H01F 27/24

(52) U.S. Cl. ..... 336/83; 336/233; 336/60; 29/602.1

(58) Field of Search ..... 336/83, 233, 60, 336/234; 29/606, 607, 609, 602.1

(56) References Cited

U.S. PATENT DOCUMENTS

| | | | | |
|---|---|---|---|---|
| 414,266 | * | 11/1889 | Thomson | 336/234 |
| 499,852 | * | 6/1893 | Pfannkuche | 336/234 |
| 619,760 | * | 2/1899 | Kinraide | 336/234 |
| 1,597,901 | * | 8/1926 | Kent | 336/234 |
| 2,043,346 | * | 6/1936 | Buckley | 336/234 |
| 2,179,661 | * | 11/1939 | Jones | 336/234 |
| 3,304,599 | * | 2/1967 | Nordin | 336/83 |
| 3,350,670 | * | 10/1967 | Strauch | 336/234 |
| 3,720,897 | * | 3/1973 | Feather et al. | 336/60 |
| 4,035,751 | * | 7/1977 | Walthew | 336/60 |

FOREIGN PATENT DOCUMENTS

| | | | | |
|---|---|---|---|---|
| 352251 | * | 4/1922 | (DE) | 336/83 |

* cited by examiner

*Primary Examiner*—Anh Mai
(74) *Attorney, Agent, or Firm*—King & Schickli PLLC

(57) ABSTRACT

The magnetic core of an inductive device is formed of a plurality of wires that extend through the inductive device, and beyond the electric windings. The ends of the wires are formed around the electric windings, meet, and are connected together enveloping the magnetic core and windings forming a complete magnetic circuit. The inductive device may be a transformer with two or more windings, a choke coil with only one winding, or other inductive device. The electric windings may be wound directly onto the wire magnetic core, or may be formed separately and then placed on the magnetic core. A mounting post or the like may be bound into the core and used as a mount for the inductive device; and, cooling tubes and/or large rods for support may be incorporated into the core.

19 Claims, 2 Drawing Sheets

Fig. 6
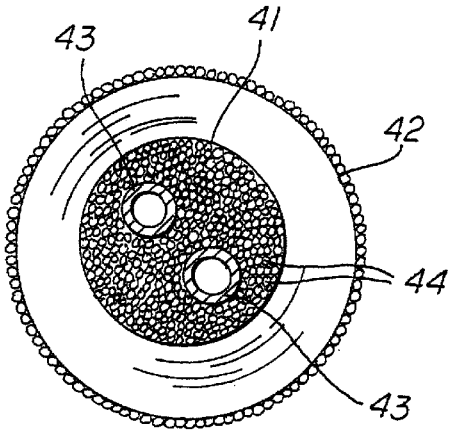
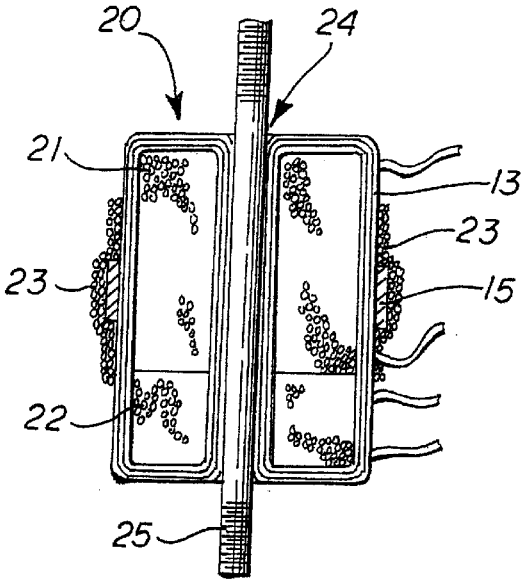
Fig. 3
Fig. 4a
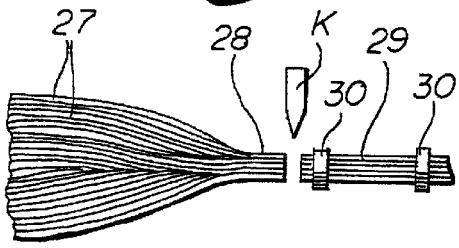
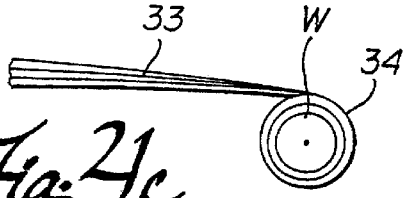
Fig. 4c
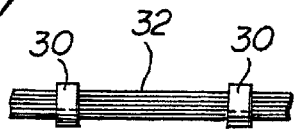
Fig. 4d
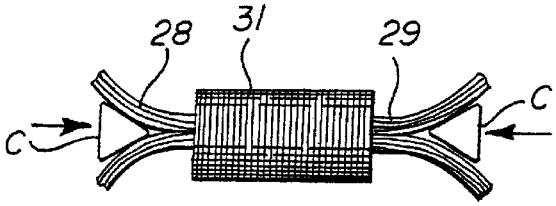
Fig. 4e
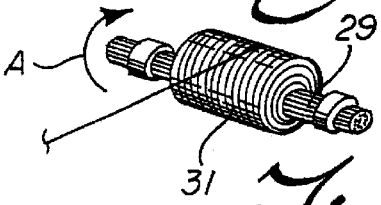
Fig. 4b

SHIELDED WIRE CORE INDUCTIVE DEVICES

This application is a CIP of 09/203,105 filed Nov. 30, 1998.

FIELD OF THE INVENTION

The present invention relates to the field of shielded inductive devices, and more particularly to shielded wire core inductive devices such as transformers, chokes, coils, ballasts, and the like.

BACKGROUND OF THE INVENTION

It is common and universal for low frequency application transformers and other inductive devices to be made up of a magnetic core comprising a plurality of sheets of steel, the sheets being die cut and stacked to create the desired thickness of a core. For many years the thickness (thus number of necessary pieces) of the stampings has been determined by a strict set of constraints-magnitude of eddy currents versus number of necessary pieces. For that reason, individual sheets of selected thickness are oxide-coated, varnished or otherwise electrically insulated from one another in order to reduce/minimize eddy currents in the magnetic core.

The magnetic core of a transformer or the like generally passes through the center of the electric winding, and closes on itself to provide a closed magnetic circuit. Since the magnetic core then supports the electric windings, it is natural that the core has also been used as the support for the transformer. That is to say, one attaches the magnetic core to a container or baseboard in order to support the transformer.

Transformers and other inductive devices inherently generate heat, and the heat must be dissipated or the power characteristics of the device will change. If the transformer or other device becomes too hot, the electric windings can become short circuited and burn out. In small devices, one usually relies on air cooling, sometimes with metal fins/heat sinks or the like to assist in dissipating the heat. In large devices, the windings and magnetic core may be cooled by forced air or immersed in an oil or other fluid. One then may use fins on the container, radiator pipes, or both, so convection currents move the heated fluid through the cooling fins or pipes. If further cooling is needed, one generally resorts to pumps to force fluid movement and/or fans to move more air across the cooling means.

When a stack of metal sheets is used as the magnetic core for an inductive device, it is usual to provide a shape, such as an E with the electric windings on the center leg of the E. After the windings are in place, an additional stack of sheets usually in an I configuration is applied to connect the ends of the E, thereby completing the magnetic circuit. Using such a technique, it will be understood that the windings are necessarily wound separately, and subsequently placed on the magnetic core. The windings must therefore be large enough to slip onto the magnetic core. Such construction contributes to the inherent noisiness of an inductive device. because the electric windings must be somewhat loose on the core. As a result, when an alternating voltage is applied to the electric windings, the sheets making up the core tend to vibrate with the alternating magnetic field or in sympathy in a subharmonic. Any resulting gaps and spaces between the electrical components and the magnetic components also reduce coupling and efficiency of action.

Transformers and other inductive devices also inherently generate electromagnetic fields. Such fields external to the device lessen efficiency, as well as pose interferences to the immediately surrounding environment. Although the strength of these electromagnetic fields decreases with distance from the transformer, shielding of either the electromagnetic field source or the affected components is often required. As components in today's electronics are made more sensitive and their packaging more dense, susceptibility to electromagnetic interaction increases dramatically. To assure optimum performance of these components, stray electromagnetic fields must be minimized often at a substantial cost. As noted above, one manner in which these fields may be minimized is to provide shielding around the source in order to contain the electromagnetic fields and to prevent interference from external sources.

Thus, an important aspect of the present invention is to provide a shielded wire core inductive device, such as a transformer, in an efficient and cost effective manner.

SUMMARY OF THE INVENTION

Accordingly, it is a primary object of the present invention to provide a method and apparatus for overcoming the limitations of the prior art, and to provide an improved inductive device having a magnetic core formed from a plurality of wires.

Another object of the present invention is to provide a shielded inductive device by extending the wires forming the magnetic core around the electric windings and the magnetic core to substantially contain electromagnetic fields emanating from the device.

It is another object of the present invention to provide a method of making a shielded inductive device utilizing a plurality of wires to form the magnetic core and to provide shielding.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, there is provided an improved inductive device, the magnetic core comprising a plurality of wires bundled to form the core. The electric windings are either wound directly onto the magnetic core, or are wound separately and slipped over the core.

In accordance with an important aspect of the present invention, the ends of the wires forming the magnetic core are spread and formed over the electric windings, the two ends of the wires meeting to form a complete magnetic circuit. A band or other connector means holds the ends of the wires together. Advantageously, the wires formed in this manner envelop the electric windings and magnetic core to provide a shield substantially containing the electromagnetic fields emanating from the device and reducing the intrusion of electromagnetic fields from external sources. Additional shielding may be provided by binding at least a portion of the wires forming the shield with a transversely wound wire.

The shielded inductive device may include a mounting post bound within the plurality of wires forming the magnetic core and extending therefrom for supportably mounting the device. The mounting post may extend from either side or both sides of the magnetic core as desired. Also, the make-up of the magnetic core may be otherwise varied considerably. Wire of various diameters may be used to achieve greater density of the core; a few large wires may be spaced around the core to provide rigidity; and, one or more tubes may be incorporated into the core, the tubes carrying a fluid for cooling the inductive device. The cooling tubes are preferably constructed of non-magnetic and non-electrical-conducting material.

In carrying out the inventive method, the step of forming the magnetic core includes forming a magnetic core from a plurality of wires, placing at least one electric winding along the length of the formed core, and shielding the inductive device by forming the wires of the magnetic core over the at least one electric winding to envelop the winding and form a complete magnetic circuit.

Still other objects of the present invention will become apparent to those skilled in this art from the following description wherein there is shown and described the preferred embodiments of this invention, simply by way of illustration of some of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification, illustrates several aspects of the present invention, and together with the description serves to explain the principles of the invention. In the drawings:

FIG. 3 is a cross-section view similar to FIG. 2 but showing the electric windings formed side by side on the magnetic core in an alternate embodiment of the invention;

FIG. 4*a* is an illustration showing the step of forming a magnetic core by gathering a plurality of wires pulled from a creel to form a bundle, securing the wires with bands, and severing the bundled wires;

FIG. 4*b* is an illustration showing the step of forming an electric winding directly on the magnetic core;

FIGS. 4*c* and 4*d* are illustrations showing an alternate method for forming a magnetic core by winding one or a plurality of wires on a spindle, and severing the wound wires to form the core;

FIG. 4*e* is an illustration showing the step of shielding the transformer by forming the plurality of wires of the magnetic core over the electric windings to envelop the windings and form a complete magnetic circuit.

FIG. 6 is a top cross-sectional view showing an alternate embodiment of the magnetic core of an induction device including a plurality of tubes for passing a fluid therethrough to remove heat from the device.

Reference will now be made in detail to the present preferred embodiment of the invention, an example of which is illustrated in the accompanying drawings.

DETAILED DESCRIPTION OF THE PREFERRED EMBODIMENT

Figure 1:
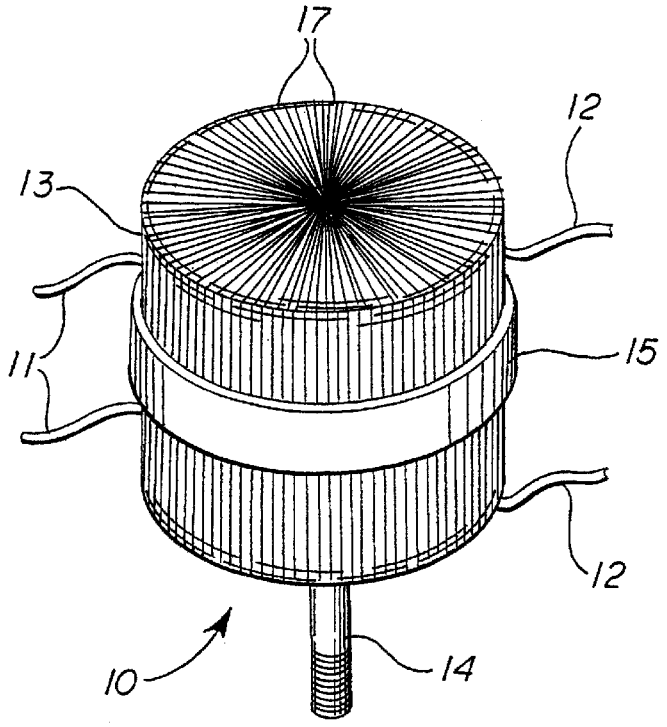
FIG. 1 is a perspective view of a transformer made in accordance with the present invention.

Reference is now made to FIG. 1 showing an improved transformer 10 having leads 11 for connecting a power source (not shown) to the primary winding of the transformer 10, and leads 12 for connecting the secondary winding to a load (not shown). Those skilled in the art will realize that designation of primary and secondary windings is somewhat arbitrary, and that one may use the leads 12 for connection to the primary winding, and the leads 11 for connection to a load. The designations of "primary" and "secondary" are therefore used herein as a convenience, and it should understood that the windings are reversible.

Figure 2:
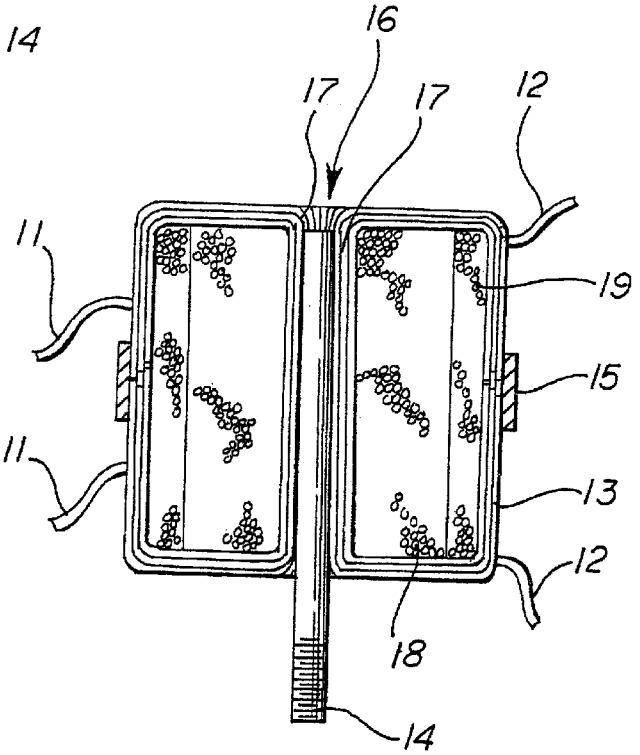
FIG. 2 is a cross-sectional view of the transformer showing electric windings formed on a magnetic core of wires, the wires enveloping the electric windings and the core to provide shielding in accordance with the present invention.

As best shown in FIG. 2 and in accordance with an important aspect of the present invention, a magnetic core 16 of the transformer 10 is made up of a plurality of wires 17 rather than the conventional sheets of steel. As is usual, however, the electric windings 18 and 19 are received on the magnetic core 16.

The plurality of wires 17 utilized to form the magnetic core 16 extend outwardly therefrom and are further formed around and envelop the electric windings 18 and 19. The ends of the plurality of wires 17 meet, and are held together by a band 15 forming a complete magnetic circuit. The leads 11 and 12 pass between the plurality of wires 17 to connect to the electric windings 18 and 19, respectively.

In accordance with another important aspect of the present invention, the wires 17 form a shield 13 substantially containing electromagnetic fields emanating from the transformer 10 and reducing the intrusion of electromagnetic fields including electromagnetic interference and/or magnetic flux from external sources. Additional shielding may be provided as shown in FIG. 3 by binding at least a portion of the wires forming the shield 13 with a transversely wrapped wire 23. Preferably, the wire 23 is a fine iron or steel wire for binding the ends of the wires 17, thus replacing the band 15, or at least a portion of the shield 13.

A mounting post 14, preferably threaded, extends from the bottom of the transformer 10 providing a convenient mounting means for the transformer 10. Centrally of the magnetic core 16, the mounting post 14 is held in place simply by being embedded within the plurality of wires 17 forming the magnetic core 16. Of course, the mounting post 14 may support the transformer 10 from below, as illustrated in FIGS. 1 and 2, or alternatively may extend from the top of the transformer 10 with the transformer 10 depending from the mounting post 14.

As shown in FIG. 3, an alternate embodiment of a transformer 20 in accordance with the present invention is similar to the transformer 10, but the electrical windings 21 and 22 are positioned beside one another on magnetic core 24 instead of one upon the other as in the transformer 10. In addition, the mounting post 25 extends from both the top and bottom of the transformer 20. Necessarily, the transformer 20 may be mounted from either top or bottom, or from both.

While the use of a mounting post provides a readily convenient manner by which to mount a transformer, one may wish to utilize the transformer of the present invention in a conventional setting, wherein the mounting post is not convenient. Conventional transformers are typically supported by their magnetic core structure. Since the magnetic core of the preferred embodiment of the present invention is not adapted to provide similar support, one might utilize the mounting posts 14 or 25 to fix the transformer to a bracket that can be mounted as a conventional transformer. Alternatively, the magnetic core area may have no stud, but be filled solely with core wires with mounting secured by other means, such as external strapping.

It is believed that the use of a plurality of wires to form a magnetic core and electromagnetic shield will yield an efficient method for making a shielded inductive device. In accordance with that method, FIG. 4*a* shows the step of forming a magnetic core 29 by gathering a plurality of wires 27 pulled from a creel (not shown) to form a bundle 28, and severing the bundle at a predetermined length with a knife K or the like. The resulting magnetic core 29 is held together by bands 30 or the like. It will be recognized that the plurality of wires 27 pulled from the creel may all be the same diameter or may be a combination of different diameters. As noted above, the use of different diameter wires allows for a more dense packing of the magnetic core 29, thereby improving its magnetic characteristics.

In accordance with the present preferred method, at least one electric winding 31 is next placed on the magnetic core 29. The electric winding may be formed by winding a coil of wire or a spindle S, in accordance with the prior art, for slipping over a magnetic core. In accordance with an important aspect of the present preferred invention, however, the electric windings 31 are wound directly on the magnetic core 29, as shown by action arrow A in FIG. 4*b*. Advantageously, this direct placement of the electric windings 31 onto the magnetic core 29 provides a more efficient, and thus more economical method of manufacturing by eliminating steps in the prior art manufacturing methods.

Another advantage is that, by winding the electric windings 31 directly on the magnetic core 29, the electric windings 31 assist in binding the wires which form the core tightly together, thereby offering several mechanical and electrical advantages. These advantages include tighter magneto-electric coupling and reduced vibrational noise from the core.

FIG. 4*c* illustrates an alternate method for forming a magnetic core in accordance with the present invention. In the alternate method, a magnetic core 32 is formed by feeding one wire or a plurality of wires 33 to a winder W. Since a winder W of this type may be very high speed, it would be most practicable to use a single, thin wire to form the magnetic core 32. However, one may also use a variety of wires having different diameters, the wires being geometrically sized and arranged to be densely packed. The plurality of wires 33 are removed from the winder W, severed at a predetermined length, and straightened as shown in FIG. 4*d*. By appropriately deforming the wound wires 34 before severing, the ends will be substantially square. As in the preferred method shown in FIG. 4*a*, bands 30 or the like hold the plurality of wires 33 together thus forming the magnetic core 32.

With the electric windings 35 in place on the preferred magnetic core 29, the next step in the preferred method is to shield the inductive device by forming the plurality of wires 28 extending from the magnetic core 29 around the electric windings to envelop the windings and form a complete magnetic circuit. FIG. 4*e* illustrates one manner of forming the plurality of wires 28, for example, by using a pair of cones C to spread the wires generally radially. Conventional means may then be used to form the wires 28 completely around the electric windings 35 to form a shield generally as shown in FIG. 1.

Those skilled in the art will recognize that the magnetic core of an inductive device preferably forms a complete magnetic circuit. As best shown in FIGS. 1 and 2, the forming of the plurality of wires 17 extending from the magnetic core 16 around the electric windings 18, 19 causes the ends of the wires to meet. In accordance with the inventive method, the wires 17 are preferably prepared by having their ends cleaned; then, when the ends of the wires meet, they are held together by the band 15 or other connection means. Alternatively, the band 15 may be used in conjunction with or be replaced by a fine iron or steel wire wrapped transversely around the device.

In addition to providing the desired complete magnetic circuit, it will be seen that the entire inductive device, e.g., transformer 10, is thus covered by the wires 17 forming shield 13. The device made in accordance with the method of the present invention may therefore be used in electrically noisy environments without adversely affecting or being adversely affected by surrounding components.

It will therefore be understood that the present invention provides a highly efficient method for making an inductive device and a highly efficient inductive device. It should be noted that the core wires of the present invention would be made of substantially the same silicon and other steel that is used for conventional cores. Furthermore, the process of drawing the wire produces the same desirable grain structure—and in the proper direction—as is found in the present stamped sheets. The wires of the present invention will be coated to be electrically insulated from one another to reduce eddy currents, and the diameter of the wires will be selected to reduce eddy currents.

Figure 5:
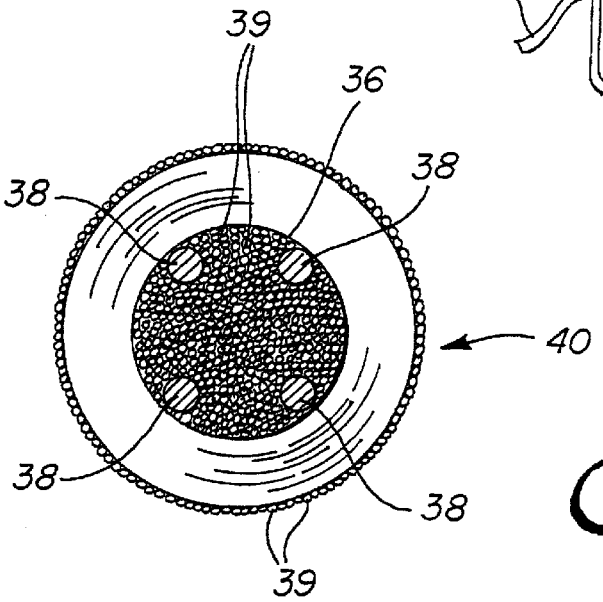
FIG. 5 is a top cross-sectional view showing an alternate embodiment of the magnetic core of an induction device including a plurality of large diameter wires for supporting the device.

The foregoing description of a preferred embodiment of the invention has been presented for purposes of illustration and description. It is not intended to be exhaustive or to limit the invention to the precise form disclosed. Obvious modifications or variations are possible in light of the above teachings. For example, FIG. 5 illustrates a magnetic core 36 having an electric winding 37 therearound. The magnetic core 36 is formed of four large wires, or rods, 38, and a plurality of smaller wires 39. It is contemplated that the large wires 38 act as structural members on which the entire inductive device 40 is supported, while the small wires 39 provide the above discussed advantages.

Similarly, FIG. 6 illustrates an inductive device or the like having a magnetic core 41 and an electric winding 42 therearound. The magnetic core 41 is formed of a plurality of tubes 43 extending therethrough, and a plurality of smaller wires 44. The tubes 43 are preferably made of a polymeric material, but they may be made of other non-magnetic materials. In accordance with another aspect of the present invention, the tubes 43 provide direct cooling of the magnetic core 41, which is much more efficient than secondary cooling techniques such as passing a fluid over the outside of the transformer.

The preferred embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed is:

1. A shielded inductive device comprising:

a magnetic core formed of a plurality of wires, said wires each having first and second ends;

at least one electric winding positioned on said magnetic core;

wherein said first and second ends of said plurality of wires extend around said at least one electric winding substantially enveloping said magnetic core and said at least one electric winding and forming a complete magnetic circuit; and wherein said plurality of wires includes wires of at least two different diameters to increase the density of said magnetic core, whereby magnetic flux emanating from the inductive device is substantially contained therein and the intrusion of electromagnetic interference and magnetic flux from external sources is significantly reduced.

2. The shielded inductive device of claim 1, further comprising a mounting post held within said plurality of wires and extending therefrom for supporting the shielded inductive device.

3. The shielded inductive device of claim 2, further comprising a wire transversely wrapped around at least said first and second ends of said plurality of wires to provide further containment of magnet flux emanating from the device and reduction of the intrusion of electromagnetic interference and magnetic flux from external sources.

4. The inductive device of claim 1 further comprising at least one tube intermingled within said plurality of wires for carrying a fluid for removing heat from within the inductive device.

5. A shielded transformer comprising:

a magnetic core formed of a plurality of wires, said wires each having first and second ends;

at least two electric windings positioned on said magnetic core, at least one of said windings securely binding said magnetic core;

wherein said first and second ends of said plurality of wires extend around said at least two electric windings substantially enveloping said magnetic core and said at least two electric windings, and forming a complete magnetic circuit; and wherein said plurality of wires includes wires of at least two different diameters to increase the density of said magnetic core, whereby magnetic flux emanating from the transformer is substantially contained therein and the intrusion of electromagnetic interference and magnetic flux from external sources is significantly reduced.

6. The shielded transformer of claim 5, wherein said at least two electric windings include primary and secondary windings;

said primary winding directly contacting said magnetic core; and said secondary winding wound substantially on top of said primary winding.

7. The transformer of claim 6 wherein said secondary winding also directly contacts said magnetic core adjacent said primary winding.

8. The shielded transformer of claim 5 further comprising a mounting post held within said plurality of wires and extending therefrom for supporting the shielded transformer.

9. A method for making a shielded inductive device, comprising the steps of:

forming a magnetic core of a plurality of wires including intermingling a first group of wires having a first diameter with a second group of wires having a different diameter to increase the density of said magnetic core;

placing at least one electric winding along the length of said magnetic core; and shielding the inductive device by forming said plurality of wires over said at least one electric winding to envelop said at least one winding and form a complete magnetic circuit.

10. The method for making a shielded inductive device according to claim 9, wherein the step of placing said at least one electric winding along the length of said magnetic core includes winding a second electric winding on said first electric winding.

11. The method for making a shielded inductive device according to claim 9, wherein the step of placing said at least one electric winding along the length of said magnetic core includes winding a second electric winding directly on said magnetic core adjacent said first electric winding.

12. The method for making a shielded inductive device according to claim 9, wherein said shielding step includes wrapping a wire around at least a portion of said formed plurality of wires.

13. The method for making a shielded inductive device of claim 9, wherein the intermingling step includes intermingling a third group of wires having a third diameter to further increase the density of said magnetic core.

14. The method for making a shielded inductive device of claim 9, wherein the step of placing at least one electric winding along the length of said magnetic core includes winding said at least one winding directly onto said magnetic core.

15. The method for making a shielded inductive device of claim 14, wherein said shielding step includes wrapping a wire around at least a portion of said formed plurality of wires.

16. The method for making a shielded inductive device of claim 14, wherein the intermingling step includes intermingling a third group of wires having a third diameter to further increase the density of said magnetic core.

17. The method for making a shielded inductive device of claim 9, wherein the step of placing at least one electric winding along the length of said magnetic core includes securely binding said magnetic core with said at least one winding.

18. The method for making a shielded inductive device of claim 17, wherein said shielding step includes wrapping a wire around at least a portion of said formed plurality of wires.

19. The method for making a shielded inductive device of claim 17, wherein the intermingling step includes intermingling a third group of wires having a third diameter to further increase the density of said magnetic core.

* * * * *